US005901775A

United States Patent [19]

Musschoot et al.

[11] Patent Number: 5,901,775

[45] **Date of Patent: *May 11, 1999**

2

[54] TWO-STAGE HEAT TREATING DECORING AND SAND RECLAMATION SYSTEM

[75] Inventors: Albert Musschoot, Barrington Hills; Daniel T. Lease, McHenry, both of Ill.

[73] Assignee: General Kinematics Corporation, Barrington, Ill.

[ * ] Notice: Under 35 U.S.C. 154(b), the term of this patent shall be extended for 2 days.

[21] Appl. No.: 08/880,605

[22] Filed: Jun. 23, 1997

Related U.S. Application Data

[63] Continuation-in-part of application No. 08/844,738, Apr. 21, 1997, which is a continuation-in-part of application No. 08/770,343, Dec. 20, 1996.

[51] Int. Cl.[6] ..... B22D 29/00

[52] U.S. Cl. ..... 164/404; 164/5; 164/131; 164/132; 266/252

[58] Field of Search ..... 164/404, 401, 164/5, 131, 132; 266/251, 252, 257; 148/710

[56] References Cited

U.S. PATENT DOCUMENTS

| | | |
|---|---|---|
| Re. 33,542 | 2/1991 | Musschoot . |
| 1,789,860 | 1/1931 | Bennington . |

(List continued on next page.)

FOREIGN PATENT DOCUMENTS

| | | |
|---|---|---|
| 1197981 | 12/1985 | Canada . |
| 0 546 210 | 6/1993 | European Pat. Off. . |
| 2 315 958 | 4/1974 | Germany . |
| 2 337 894 | 11/1974 | Germany . |
| 2 914 221 | 10/1980 | Germany . |
| 4 012 158 | 11/1990 | Germany . |
| 56-53867 | 5/1981 | Japan . |
| 58-25860 | 2/1983 | Japan . |
| 59-39464 | 3/1984 | Japan . |
| 59-219410 | 12/1984 | Japan . |
| 60-92040 | 5/1985 | Japan . |
| 62-74022 | 4/1987 | Japan . |
| 63-16853 | 1/1988 | Japan . |
| 63-108941 | 5/1988 | Japan ..... 164/404 |
| 234 810 | 4/1969 | U.S.S.R. . |
| 1 129 012 | 12/1984 | U.S.S.R. . |
| 1 125 757 | 8/1968 | United Kingdom . |
| 1 392 405 | 4/1975 | United Kingdom . |
| 1 564 151 | 4/1980 | United Kingdom . |
| 1 569 152 | 6/1980 | United Kingdom . |
| 2230720 | 10/1990 | United Kingdom . |
| WO 92/20478 | 11/1992 | WIPO . |
| WO 94/04297 | 3/1994 | WIPO . |
| WO 95/19860 | 7/1995 | WIPO . |
| WO 97/30805 | 8/1997 | WIPO . |

OTHER PUBLICATIONS

CEC Consolidated Engineering Company, "Quality Heat Processing Equipment: Furnaces Ovens Dryers Washers Systems," Consolidated Engineering Company, Kennesaw, Georgia, pp. 1–15.

Dr. Károly Erdész, "Vibrational Thermal Processing Equipment —Design and Application," Hungary (1995).

General Kinematics, "General Kinematics Innovations—Resourceful answers to process and material handling needs through creative engineering", Bulletin 586R, General Kinematics Corporation, Barrington, Illinois. pp. 1–10 (1986).

(List continued on next page.)

*Primary Examiner*—J. Reed Batten, Jr.

*Attorney, Agent, or Firm*—Marshall, O'Toole, Gerstein, Murray & Borun

[57] ABSTRACT

In order to effectively heat treat and decore a metal casting, and thereafter fully reclaim the core sand for reuse, a two-stage system processes metal castings and core sand formed of sand and binder. The two-stage system includes a first stage for removing the core sand from the metal casting while at the same time heat treating the metal casting, and it also includes a separate, second stage for reclaiming the core sand. For this purpose, fluidized and heated sand is utilized as the castings and sand are conveyed together in the first stage and the sand alone is conveyed in the second stage for recirculation of at least a portion of the sand to the first stage.

25 Claims, 6 Drawing Sheets

U.S. PATENT DOCUMENTS

| | | | |
|---|---|---|---|
| 2,385,962 | 10/1945 | Barnett . | |
| 2,813,318 | 11/1957 | Horth . | |
| 2,821,375 | 1/1958 | Andrews . | |
| 2,856,273 | 10/1958 | Beber et al. . | |
| 2,988,351 | 6/1961 | Barnett et al. . | |
| 3,053,704 | 9/1962 | Munday . | |
| 3,534,946 | 10/1970 | Westerkamp et al. . | |
| 3,607,071 | 9/1971 | Staffin et al. . | |
| 3,676,647 | 7/1972 | Staffin et al. . | |
| 3,677,404 | 7/1972 | Staffin et al. . | |
| 3,737,280 | 6/1973 | Cromp | 432/41 |
| 3,760,800 | 9/1973 | Staffin et al. . | |
| 3,871,438 | 3/1975 | Vissers et al. | 164/5 |
| 3,989,227 | 11/1976 | Musschoot . | |
| 4,068,389 | 1/1978 | Staffin et al. | 34/57 |
| 4,140,467 | 2/1979 | Ellison et al. | 432/72 |
| 4,161,389 | 7/1979 | Staffin et al. | 432/58 |
| 4,177,952 | 12/1979 | Rikker | 241/40 |
| 4,211,274 | 7/1980 | Slowinski et al. | 164/401 |
| 4,242,077 | 12/1980 | Hyre | 431/19 |
| 4,294,436 | 10/1981 | Takahashi | 266/257 |
| 4,340,433 | 7/1982 | Harding . | |
| 4,392,814 | 7/1983 | Harding | 431/170 |
| 4,411,709 | 10/1983 | Nakanishi . | |
| 4,415,444 | 11/1983 | Guptail | 209/3 |
| 4,427,375 | 1/1984 | Di Rosa | 432/58 |
| 4,457,352 | 7/1984 | Scheffer | 164/5 |
| 4,457,788 | 7/1984 | Staffin et al. . | |
| 4,478,572 | 10/1984 | Selli | 432/13 |
| 4,512,821 | 4/1985 | Staffin et al. . | |
| 4,519,718 | 5/1985 | Staffin et al. | 374/45 |
| 4,524,957 | 6/1985 | Staffin et al. | 266/252 |
| 4,544,013 | 10/1985 | Kearney et al. | 164/5 |
| 4,547,228 | 10/1985 | Girrell et al. . | |
| 4,563,151 | 1/1986 | Vogel | 432/15 |
| 4,577,671 | 3/1986 | Stephan | 164/401 |
| 4,579,319 | 4/1986 | Sasaki | 266/252 |
| 4,582,301 | 4/1986 | Wünning | 266/87 |
| 4,604,055 | 8/1986 | Mackenzie | 432/58 |
| 4,613,713 | 9/1986 | Staffin et al. | 585/241 |
| 4,620,586 | 11/1986 | Musschoot | 164/253 |
| 4,623,400 | 11/1986 | Japka et al. . | |
| 4,636,168 | 1/1987 | Sandstrom et al. | 432/58 |
| 4,648,836 | 3/1987 | Thom | 432/107 |
| 4,671,496 | 6/1987 | Girrell et al. | 266/78 |
| 4,700,766 | 10/1987 | Godderidge | 164/5 |
| 4,738,615 | 4/1988 | Bailey et al. | 432/15 |
| 4,779,163 | 10/1988 | Bickford et al. | 361/212 |
| 4,830,605 | 5/1989 | Hodate et al. | 431/170 |
| 4,955,425 | 9/1990 | McKenna | 164/269 |
| 4,957,431 | 9/1990 | Eng et al. | 432/31 |
| 5,018,707 | 5/1991 | Hemsath et al. | 266/254 |
| 5,169,913 | 12/1992 | Staffin et al. | 526/65 |
| 5,253,698 | 10/1993 | Keough et al. | 164/269 |
| 5,271,450 | 12/1993 | Bailey | 164/5 |
| 5,279,741 | 1/1994 | Schott | 210/634 |
| 5,294,094 | 3/1994 | Crafton et al. | 266/44 |
| 5,332,139 | 7/1994 | Heath et al. | 164/404 X |
| 5,350,160 | 9/1994 | Crafton et al. | 266/252 |
| 5,354,038 | 10/1994 | Crafton | 266/44 |
| 5,378,434 | 1/1995 | Staffin et al. | 422/141 |
| 5,423,370 | 6/1995 | Bonnemasou et al. | 164/132 |
| 5,439,045 | 8/1995 | Crafton | 164/5 |
| 5,531,423 | 7/1996 | Crafton et al. | 266/44 |
| 5,738,162 | 4/1998 | Crafton | 164/5 |
| 5,829,509 | 11/1998 | Crifton | 164/5 |

OTHER PUBLICATIONS

Kogyo–Kanetsu, "Economical Used Energy Type, Continuing Heat Treating Furnace For Aluminum Castings," pp. 1–17 Published Mar. 1984.

Paul M. Crafton, "Heat Treating, Aging System also Permits Core Sand Removal," Reprinted from Sep. 1989 Modern Casting Magazine, Consolidated Engineering Co., Kennesaw, GA.

Sales Brochure Describing Thermfire Brand Sand Reclamation, Gudgeon Brothers, Ltd., Believed to be Known by Others Prior to Sep., 1989.

Sales Brochure Describing Simplicity/Richards Gas–Fired Thermal Reclamation System, Simplicity Engineering, Inc., Believed to be Known by Others Prior to Sep., 1989.

Sales Brochure Describing Air Trac Brand Fluidizing Conveyor, Air Trac Systems Corp., Believed to be Known By Others Prior To Sep., 1989.

Sales Brochure Describing Fluid Bed Clacifire Thermal Sand Reclamation Systems, Dependable Foundry Equipment Co., Inc., Believed to be Known by Others Prior to Sep., 1989.

Beardsley & Piper, Advertisement describing Beardsley & Piper PNEU–Reclaim Sand Reclamation Units (Dec., 1989).

Advertisement describing Fataluminium Sand Reclamation Units (Dec., 1989).

TWO-STAGE HEAT TREATING DECORING AND SAND RECLAMATION SYSTEM

RELATED APPLICATION

This is a continuation-in-part of earlier filed, co-pending application Ser. No. 08/844,738, filed Apr. 21, 1997, which is a continuation-in-part of earlier filed, co-pending application Ser. No. 08/770,343, filed Dec. 20, 1996.

FIELD OF THE INVENTION

The present invention is generally related to the foundry industry and, more particularly, to a vibratory sand reclamation system for reclaiming foundry sand.

BACKGROUND OF THE INVENTION

As is well known in the art, vibratory processing equipment has been developed to satisfy a wide range of diverse applications. It is oftentimes the case that a system for handling any of a variety of different materials will include as an integral component a vibratory conveyor. Generally, vibratory conveyors may be used for transporting materials to and through a processing section to a post-processing location. In one particular application, a vibratory conveyor may find advantageous use in a foundry for conveying metal castings or the like from one point to another after they have been formed. There is another very important need to be able to remove sand molds and sand cores and to thereafter reclaim and recirculate the foundry sand which is typically bonded by a resin to form the sand molds and to make the sand cores used in the molds to create interior voids during conventional production of metal castings. After metal castings have been formed, the sand molds and sand cores must be removed, following which the sand must be reclaimed which has typically been accomplished by using a machine called a shake-out.

In this connection, the shake-out is typically of a vibratory nature and operates such that the moisture and clay bonded type sand is simply shaken loose from the metal castings. Optionally, the sand molds and sand cores using resin bonded type sand may be subjected to hot air for the purpose of causing the resin binder in the sand to break down so that the sand will fall away from the metal castings and core passages. In either case, the sand will typically be collected in the bottom of a chamber for further heat or chemical processing to remove any remaining resin to thereby reclaim the sand which is stored for later reuse.

As shown by Nakanishi, U.S. Pat. No. 4,411,709, it has been known that resin bonded sand molds and sand cores can be removed, and the sand simultaneously reconditioned for re-use, by heating the resin bonded molding sand and core sand at a sufficient temperature to be able to pyrolyze the resin binders in the sand. As explained in Crafton, U.S. Pat. No. 5,354,038, and later in Bonnemasou et al., U.S. Pat. No. 5,423,370, it may be advantageous for this heating to be accomplished by utilizing a fluidized bed of sand particles. In particular, Bonnemasou et al. U.S. Pat. No. 5,423,370 point outs that fluidized beds are useful for removing the sand cores from cast aluminum parts, but it also cautions that, when hot, these cast aluminum parts are such that they cannot tolerate "even modest handling."

Moreover, while it is known to use heat to reclaim the sand by pyrolyzing the resin bonding material or binder, this poses a seemingly unresolvable dilemma; namely, how to apply sufficient heat for efficient pyrolyzing of the bonding material in a manner achieving significant energy conservation. There is also a related problem in that metal castings must typically be heat treated at a specific temperature which must be controlled within close tolerance in order to avoid damage to the castings while at the same time providing a highly efficient and effective heat treatment environment. While the temperature for heat treating the metal castings may be sufficient for decoring purposes, i.e., for removing the cores that are formed of sand and resin bonding material or binder from the castings to reclaim the sand, that same temperature may not be sufficient to reclaim the sand by pyrolyzing the resin bonding material or binder.

Particularly for aluminum castings, the important competing requirements for (1) efficiently and effectively heat treating the castings in an environment where the temperature is controlled within close tolerance, (2) decoring the castings by removing the core sand therefrom, and (3) reclaiming the core sand for reuse in a manner fully ensuring that the resin bonding material or binder is completely pyrolyzed, may well be best achieved in more than a single stage.

The present invention is directed to overcoming one or more of the foregoing problems while achieving one or more of the resulting objects by providing a unique vibratory heat treating, decoring, and sand reclamation system.

SUMMARY OF THE INVENTION

It is an object of the present invention to provide an apparatus and system for removing resin bonded sand in the form of a sand mold and/or sand core from a metal casting in order to reclaim the sand for further use. It is also an object of the invention to provide such an apparatus and system having a fluidized bed through which hot castings are heat treated while being moved by vibratory forces to thereby remove sand from the castings by the combined action of vibratory forces, heated and fluidized sand, and the movement of the castings through the sand. It is a further object of the present invention to provide the vibratory casting-conveying fluidized bed as an intermediate section of a vibratory conveyor fed with reclaimed and recirculated hot sand in a continuous conveying system. It is still an additional object of the present invention to provide a two-stage system for processing metal castings and core sand formed of sand and resin bonding material or binder including an entirely separate, second stage for fully reclaiming core sand removed from metal castings for reuse.

Accordingly, the present invention is directed to an apparatus and system for removing and reclaiming sand from metal casting molds. The apparatus and system includes a fluidized bed together with means for vibrating the bed to move castings from a casting entrance for receiving the castings to a casting exit for removing the castings. Means are provided for supplying hot sand to the fluidized bed at a point generally near the casting entrance and means are also provided for removing reclaimed hot sand from the fluidized bed to be recirculated from a point generally near the casting exit. The apparatus and system also includes means for recirculating hot sand from the sand removing means to the sand supplying means where it is again fluidized. Further, the apparatus and system includes means for diverting excess sand therefrom, preferably in the form of an overburden chute having a lower edge defining a weir at a preselected level.

In an exemplary embodiment, the system comprises a heated chamber for removing and reclaiming sand, a plenum for providing hot air to the heated chamber, and a grid-like casting support surface separating the heated chamber from the plenum. The system also advantageously contemplates the casting support surface being formed to have a plurality of dividers forming a plurality of casting conveying lanes extending longitudinally through the system. Preferably, a continuous uninterrupted vibrated casting support surface defines a continuous conveying path leading from a casting loading conveyor, to and through the fluidized bed, and then to a casting exit conveyor.

As a perhaps superior alternative to utilizing dividers to form multiple casting conveying lanes, a pallet can be utilized in conjunction with a mechanical robot loading device for supporting a plurality of sand molds each containing a metal casting. The pallets for the metal castings advantageously have a plurality of casting supporting bins. Preferably, the casting supporting bins of each of the pallets permits the hot air from the plenum to pass into the fluidizing section where it fluidizes and heats sand in the fluidized bed.

In a highly preferred embodiment, the sand supplying means comprises a sand distribution conveyor having a sand distribution aperture disposed above the casting loading conveyor upstream of the casting entrance to the fluidized bed. The sand removing means also advantageously comprises a sand transfer conveyor communicating with a sand removal chute which is preferably disposed generally at a point below the casting exit conveyor at a point downstream of the casting exit to the fluidized bed. Still additionally, the sand recirculating means preferably comprises a sand return conveyor extending from the sand distribution conveyor to the sand transfer conveyor to recirculate sand to be fluidized and heated in the fluidized bed.

In a most highly preferred embodiment, the apparatus and system includes a casting entrance seal hinged from above the entrance of the fluidized bed and also includes a casting exit seal hinged from above the exit of the fluidized bed where the seals serve to conserve energy by retaining heat within the fluidized bed. Additionally, the sand distribution conveyor, sand transfer conveyor, and sand return conveyor are all most advantageously portions of an integral enclosed and insulated continuous vibratory conveying system for recirculating hot sand through the fluidized bed with much improved and efficient heat transfer characteristics.

In an alternative embodiment, a plurality of hot gas distribution ducts and hot gas permeable pallets that support the sand molds containing the metal castings are provided whereby the pallets are conveyed through the fluidized bed while supported on at least a pair of rails carried by and connected to upper surfaces of the hot gas distribution ducts.

In the alternative embodiment, the hot gas distribution ducts each preferably entirely span the width of the fluidized bed and have perforated lower surfaces in spaced relation to a bottom surface of the heated chamber. This permits hot gas to be directed into sand that surrounds the distribution ducts. The hot gas will first be directed downwardly, will next penetrate upwardly through the sand between the hot gas distribution ducts and through the pallets causing all of the loose sand to be fluidized.

In another alternative embodiment, a two-stage system for processing metal castings and core sand formed of sand and binder is disclosed. The two-stage system of this further alternative embodiment includes a first stage for removing the core sand from the metal castings, while also heat treating the metal castings. Additionally, the two-stage system includes a separate, second stage for thereafter reclaiming at least the core sand removed from the metal castings for reuse.

In the first stage of this further alternative embodiment, the two-stage system includes means for conveying the castings and sand including a casting entrance for receiving the castings and a casting exit for removing the castings and also includes means for fluidizing and heating the sand in the conveying means of the first stage to a substantially uniform heat treating temperature. This causes the castings to be heat treated while at the same time causing the binder in the core sand within the castings to break down such that the core sand is removed from the castings in at least clumps of core sand and binder. Further, the first stage includes means for transferring all of the sand from the conveying means of the first stage including the core sand removed from the castings, and including any clumps of the core sand and binder, to the second stage where the core sand is fully reclaimed for reuse by completely pyrolyzing the binder while the core sand is within the second stage.

In the second stage of this further alternative embodiment, the two-stage system comprises means for conveying the sand including a sand entrance for receiving all of the sand from the sand transferring means of the first stage and also includes means for fluidizing and heating the sand in the conveying means of the second stage to a sand reclamation temperature. This causes the core sand which is removed from the castings in the first stage, and including any clumps of core sand and binder, to be subjected to heat which is sufficient to completely pyrolyze the binder in the second stage to thereby cause the core sand to be reclaimed for reuse. Further, the second stage includes means for recirculating at least a portion of the sand from the conveying means of the second stage to the conveying means of the first stage after the core sand has been reclaimed for reuse and, advantageously, means are provided for diverting excess sand at a point downstream of where the core sand has been reclaimed for reuse.

In a highly preferred form of this further alternative embodiment, the substantially uniform heat treating temperature is a first selected temperature and the sand reclamation temperature is a second, higher selected temperature sufficient to ensure that all of the binder is pyrolyzed. It is also an advantageous feature for the two-stage system to include means for conveying core sand formed of sand and binder from a separate location directly to the second stage to be merged with the sand from the conveying means of the first stage which, as previously described, includes the core sand removed from the castings as well as any clumps of core sand and binder. With this arrangement of the present invention, the two-stage system is able to fully reclaim all core sand for reuse, including any unused or unusable cores from the core room, by completely pyrolyzing the binder while the core sand is within the second stage. Since the castings have been removed, the temperature is not limited to the metallurgical specification required by the castings.

Other objects, advantages and features of the present invention will become apparent from a consideration of the following specification taken in conjunction with the accompanying drawings.

DETAILED DESCRIPTION OF THE PREFERRED EMBODIMENT

Figure 1:
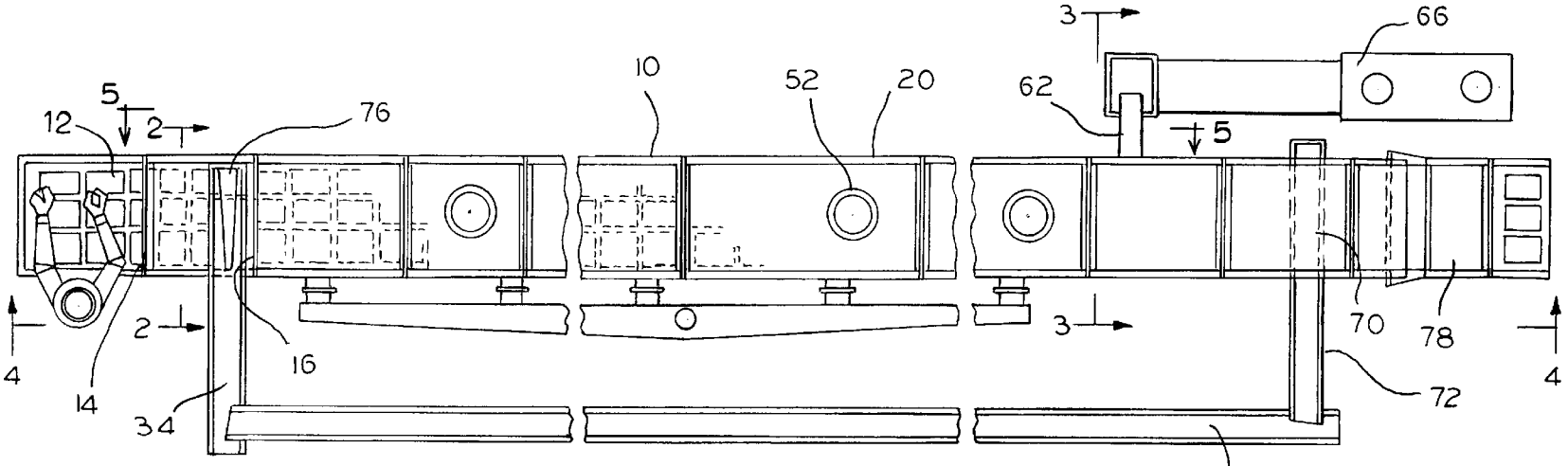
FIG. 1 is a plan view of an apparatus and system for removing, reclaiming and recirculating sand from a metal casting according to the present invention.
Figure 4:
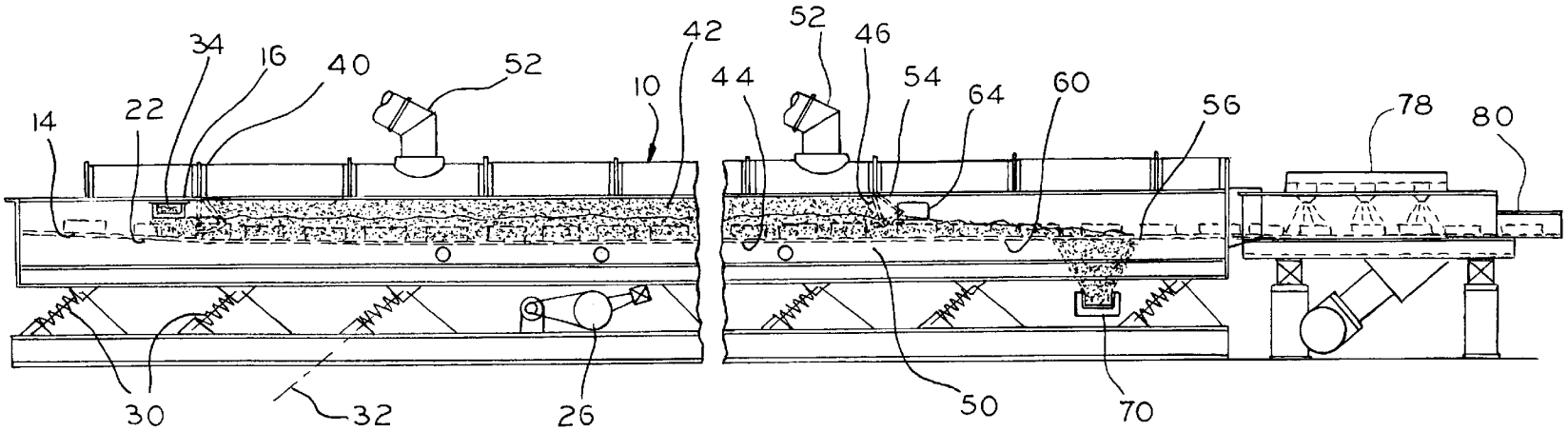
FIG. 4 is an elevational cross-sectional view taken generally along the lines 4—4 of FIG. 1.

In the illustrations given herein, and with particular reference first to FIGS. 1 and 4, the reference number 10 will be understood to designate generally an apparatus and system for removing and reclaiming sand from a metal casting in accordance with the teachings of the present invention. As shown in FIG. 1, the apparatus 10 is utilized to process metal castings such as 12, each having its sand mold and sand cores still in place as it follows a continuous, vibrated path extending from a casting loading conveyer 14 to a casting entrance 16 of a fluidized bed 20 where the processing takes place.

Figure 2:
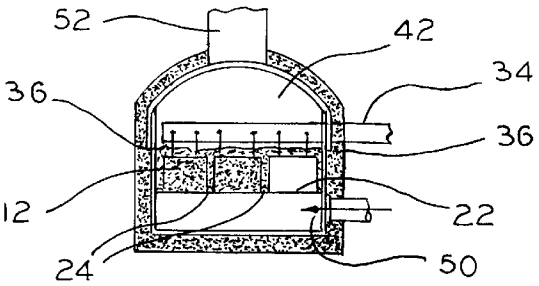
FIG. 2 is an elevational cross-sectional view taken generally along the lines 2—2 of FIG. 1.

More specifically, the casting loading conveyer 14 has a casting support surface or floor 22 that is wide enough to accommodate at least one metal casting 12, and is preferably wide enough to accommodate a plurality of metal castings 12 in generally side-by-side fashion (see, e.g., FIG. 2). As clearly illustrated in FIG. 2, the casting support surface or floor 22 may advantageously be formed so as to have a plurality of dividers 24 that extend longitudinally along the casting loading conveyor 14 so as to form a plurality of casting conveying lanes along which the metal castings 12 may move.

Referring now to FIG. 4, the casting support surface or floor 22 is vibrated by an unbalanced motor or eccentric drive 26 and associated spring and rocker arm assemblies 30 to produce vibratory forces acting generally along oblique axes such as 32. In this manner, the vibratory forces cause each of the sand molds containing the metal castings 12 to be conveyed along their respective conveying lanes toward the fluidized bed 20 for pyrolyzing the sand molds and sand cores to reclaim the sand.

Figure 6:
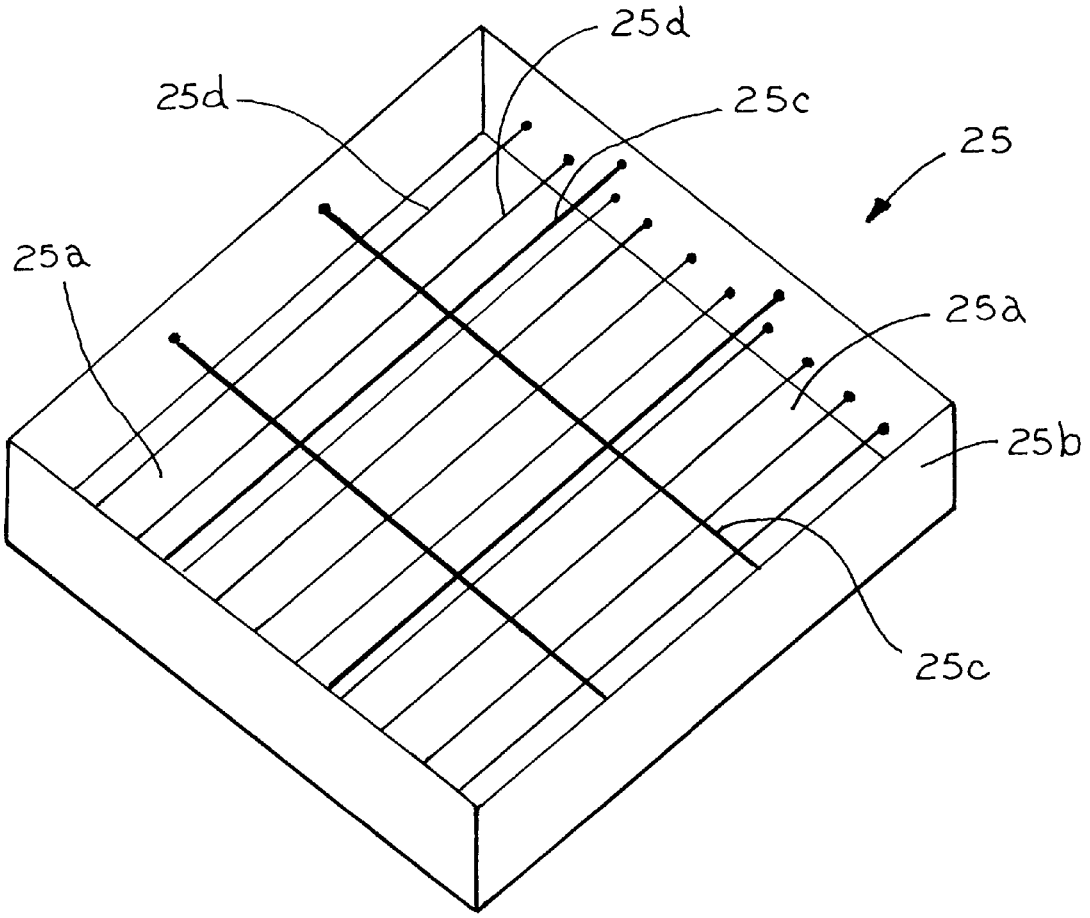
FIG. 6 is a perspective view of a pallet for supporting a plurality of metal castings as they are conveyed through the apparatus and system of FIG. 1.

Alternately, as a perhaps superior alternative, several metal castings 12 may be positioned on each of a plurality of open frame pallets 25 which can be conveyed on the casting support surface or floor 22. The pallets 25 (see FIG. 6) for the metal castings 12 advantageously each have a plurality of casting supporting bins 25*a* which may be defined by a square or rectangular side frame 25*b* and a plurality of rods 25*c* for dividing the pallet into the bins 25*a*, and the pallets 25 also may have a plurality of rods 25*d* for supporting the castings therein. In this manner, the casting supporting bins 25*a* of each of the pallets 25 is such as to permit hot air to pass through to fluidize sand in the fluidized bed 20 as will be described below.

Figure 5:
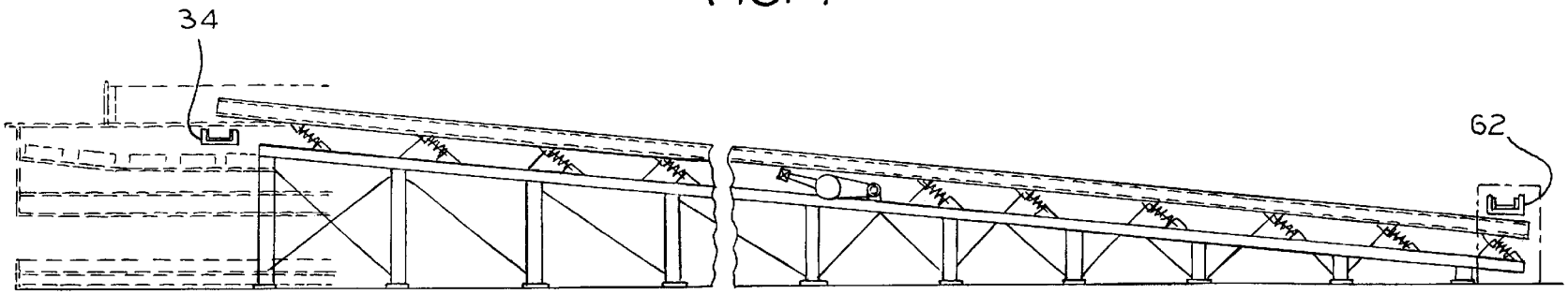
FIG. 5 is an elevational cross-sectional view taken generally along the lines 5—5 of FIG. 1.

Before entering the fluidized bed 20, hot sand is poured onto the sand molds containing the metal castings 12 to cover them to thereby provide a supply of hot sand for fluidization. The hot sand is recirculated sand poured from a sand distribution conveyer 34 that will be seen to overlie the casting loading conveyer 14 (see FIGS. 4 and 5). Referring specifically to FIG. 2, the side walls 36 on the casting loading conveyer 14 will be understood to prevent this hot sand from spilling laterally as it is conveyed toward the fluidized bed 20.

Once the hot sand has been supplied to the loading conveyor 14, the sand molds containing the metal castings 12 will move with the sand into the fluidized bed 20 through the casting entrance 16. As this occurs, the sand molds containing the metal castings 12 and the sand bed which surrounds and covers them will push back a casting entrance seal 40 (see FIG. 4) that may be hinged from a point above the casting entrance 16 to the fluidized bed 20. As will be appreciated from the foregoing, the casting entrance seal 40 serves to help retain heat within the sand in the fluidized bed 20 as the metal castings 12 are conveyed therethrough.

Once the sand molds containing the metal castings 12 reach the fluidized bed 20, they will be understood to move quite slowly within a heated chamber 42 along another casting support surface or bed floor 44 from the casting entrance 16 to a casting exit 46. The casting support surface or bed floor 44 is preferably an uninterrupted continuation of the casting support surface or floor 22 of the loading conveyer 14, i.e., they advantageously comprise a single, continuous and uninterrupted vibrated surface. Thus, the casting support surfaces or floors 22 and 44 may be supported by the same associated spring and rocker arm assemblies and vibrated by the same unbalanced motor or eccentric drive 26 to produce vibratory conveying forces generally along oblique axes such as 32.

Heated air at a controlled temperature as required by the heat treatment specification is produced in a hot air supply furnace (not shown) and is fed to a convector plenum 50 that extends below and substantially entirely along the casting support surface or floor 44. As will be recognized by those skilled in the art, the heated air fed to the plenum 50 is forced through suitable openings through and substantially entirely along the casting support surface or floor 44 into the sand bed surrounding the sand molds containing the metal castings 12 to thereby fluidize and further heat the sand in the fluidized bed 20 and pyrolyze the resin bonding material. As will also be recognized by those skilled in the art, the extent of fluidization can be varied at different points along the fluidized bed 20, if desired, by altering the temperature of the air and/or the volume of air entering the sand, e.g., by varying the size of the air openings. Since the metal castings 12 move quite slowly through the fluidized bed 20, it may prove useful to control the extent of fluidization at different points therealong.

Figure 7:
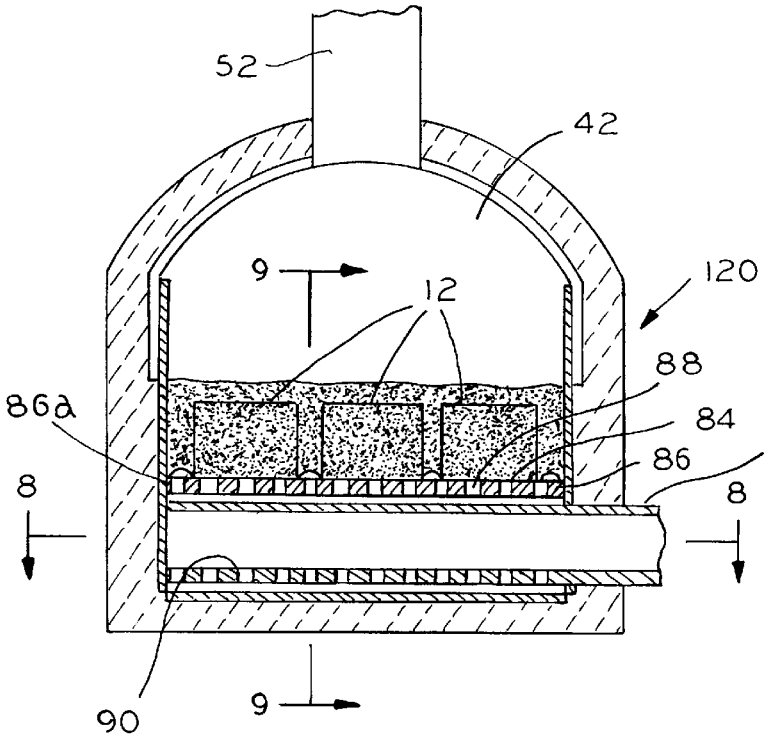
FIG. 7 is an elevational cross-sectional view similar to FIG. 2 illustrating an alternative embodiment.
Figure 8:
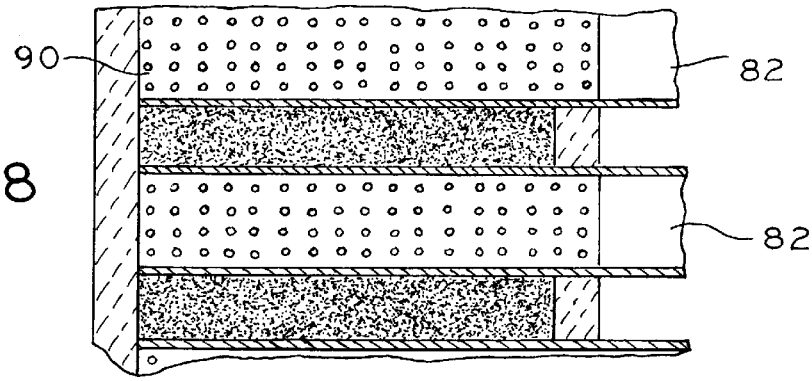
FIG. 8 is an elevational cross-sectional view taken generally along the lines 8—8 of FIG. 7.
Figure 9:
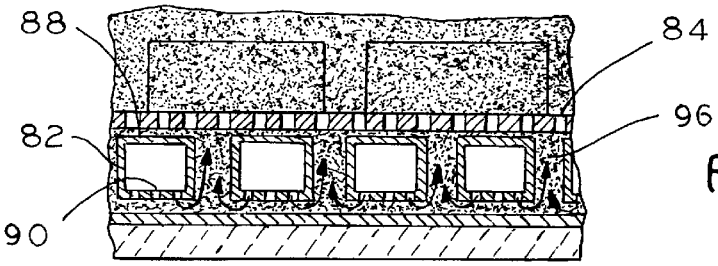
FIG. 9 is an elevational cross-sectional view taken generally along the lines 9—9 of FIG. 7.

Referring to FIGS. 7–9, an alternative embodiment of a fluidized bed 120 has been illustrated for use with the remainder of the apparatus and system 10 for removing and reclaiming sand from a metal casting in accordance with the teachings of the present invention. The casting supporting surface or floor 22 and convector plenum 50 of the embodiment of fluidized bed 20 best illustrated in FIG. 2 have been replaced by a plurality of hot air distribution ducts 82 and hot air permeable pallets 84 that support the sand molds containing the metal castings 12. With this alternative construction, the pallets 84 are conveyed through the fluidized bed 120 while supported on at least a pair of rails 86*a* and 86*b* carried by and connected to the upper surfaces 88 of the hot air distribution ducts 82 thereby eliminating the need for the casting supporting surface or floor 24.

More specifically, it will be seen that the hot air distribution ducts 82 each entirely span the width of the fluidized bed 120 and may advantageously be generally rectangular in cross-section (see FIG. 9). The hot air distribution ducts 82 also have perforated lower surfaces 90 in spaced relation to the bottom surface 92 of the heated chamber 42 within the fluidized bed 120 (see FIG. 8) to permit the hot air to be directed into the sand 96 that surrounds the distribution ducts generally as shown by the arrows in FIG. 9. The hot air will first be directed downwardly, will next penetrate upwardly through the sand 96 between the hot air distribution ducts 82 and through the pallets 84 causing all of the loose sand 96 to be fluidized including that which surrounds the sand molds containing the metal castings 12 that are being carried on the pallets 84.

As will be appreciated by those skilled in the art, the actual size and structure of the hot air distribution ducts 82, the degree and size of perforation of the lower surfaces 90, the longitudinal spacing between adjacent ones of the hot air distribution ducts 82, and other such parameters will be within the ability of those of ordinary skill who now will have a complete understanding of the inventive concept of the alternative embodiment illustrated in FIGS. 7–9.

As the sand molds containing the metal castings 12 move through the heated chamber 42, the binder in the sand molds and sand cores pyrolyzes, the pyrolyzed binder is vented from the fluidized bed 20 through vent stacks 52 at the top of the furnace 42, and the reclaimed sand from the molds and cores mixes with the fluidized sand about the metal castings 12 supported on and conveyed along the casting support surface or floor 44.

As will be appreciated, the unbalanced motor or eccentric drive 26 is utilized to move the sand molds containing the metal castings 12 through the fluidized bed 20 at different speeds. This may be desired to vary the actual time of metallurgical treatment of the castings as well as sand reclaiming treatment within the bed for a specified time based upon metallurgical considerations to ensure proper casting formation as well as fully removing the sand molds and sand cores from the castings and reclaiming the sand. The long residence time may be achieved by utilizing a first, lower motor or drive speed in which the horizontal component of vibratory force is not sufficient to overcome friction and other resistance to forward movement of the casting-conveying pallets or castings through the fluidized bed 20. The treatment period may be followed by utilizing a second, higher motor or drive speed to increase the horizontal component of vibratory force to overcome the resistance to forward movement to thereby move the castings on through the fluidized bed 20. This provides significant advantages since in the first, lower motor or drive speed the vertical component of vibratory force significantly enhances fluidization of the sand in comparison with an entirely static fluidized bed through which the castings may be pulled while nevertheless accommodating the desired long residence time. As will be appreciated, the speed of moving the sand molds containing the metal castings 12 may be varied by changing the vibratory force or revolutions per minute produced by the unbalanced motor or eccentric drive 26.

As the metal castings 12 and loose sand exit the fluidized bed 20 though the casting exit 46, they push back a casting exit seal 54. The casting exit seal 54 is preferably hinged from above the casting exit 46 and, like the casting entrance seal 40, helps retain heat within the sand in the fluidized bed 20. The castings 12 and loose molding sand (including that from the sand cores) reclaimed by heating to pyrolyze the binder moves through the casting exit seal 54 to a casting exit conveyer 56 along with the sand originally supplied by the sand distribution conveyor 34. The casting exit conveyor 56 has a casting support surface or floor 60 that is preferably an uninterrupted continuation of the casting support surface or floor 44 of the fluidized bed 20. In other words, all of the casting support surfaces or floors 22, 44 and 60 advantageously comprise a single, continuous and uninterrupted vibrated surface.

Figure 3:
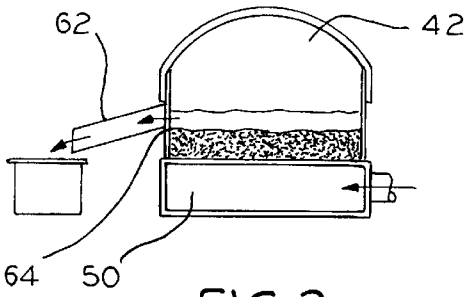
FIG. 3 is an elevational cross-sectional view taken generally along the lines 3—3 of FIG. 1.

As discussed in connection with the casting support surfaces or floors 22 and 44, the casting support surface or floor 60 may be supported by the same associated spring and rocker arm assemblies and vibrated by the same unbalanced motor or eccentric drive 26 to produce vibratory conveying forces along generally oblique axes such as 32. The vibration of the casting exit conveyer 56 will be understood to convey the metal castings 12 as well as the loose sand (including that which has been reclaimed) away from the fluidized bed 20. As seen in FIG. 3, a portion of the loose sand which is preferably approximately equal to the volume of the sand that was present in the sand cores and/or in the sand on the exterior of the metal castings 12 as the sand mold, is suitably removed by an overburden chute 62. The overburden chute 62 suitably extends from a side of the casting exit conveyer 56 and has a lower edge 64 set to serve as a sand weir at a preselected level in order to cause the appropriate amount of sand to be removed. As the metal castings 12 move past the overburden chute 62, the excess sand which has resulted from removing the sand cores and/or sand molds automatically spills out through the overburden chute 62 and is carried to a sand cooler 66, where it is cooled and stored for re-use in making new sand cores and/or sand molds for new metal castings.

After passing the overburden chute 62, the metal castings 12 and the remaining hot sand (including that which has been reclaimed) continues to move away from the fluidized bed 20 on the castings exit conveyor 56. The remaining hot sand falls away from the metal castings 12 through apertures or one or more slots (not shown) in the casting support surface or floor 60 of the exit conveyer 56 directly above a sand removal chute 70. A transfer conveyer 72 conveys the hot sand collected in the sand removal chute to a return conveyer 74, which in turn returns the sand to the sand distribution conveyer 34. The sand distribution conveyor 34 extends generally transversely of the castings loading conveyer 14, and has a distribution aperture 76 that begins above a near side of the casting loading conveyer 14 and widens toward the far side thereof. Accordingly, as the hot sand is being conveyed along the sand distribution conveyer 34, it falls through the distribution aperture 76 onto the next metal castings 12 being conveyed on the castings loading conveyer 14.

Obviously, the sand transfer conveyer 72, the sand return conveyer 74, and the sand distribution conveyer 34 may all advantageously be portions of a single enclosed and insulated continuous conveying system. This entire conveying system is preferably of the vibratory type described herein, although it will be understood that one or more portions of the conveying system could take the form of other conventional forms of conveyers. In any event, it is important to recognize that the recirculation of hot sand through the insulated continuous conveying system significantly increases the efficiency of the system by conserving on energy required to heat the sand.

With regard to the metal castings 12, the casting exit conveyor 56 continues to transport them even after the hot sand has been removed for recirculation through the sand removal chute 70. The metal castings 12 will typically be conveyed by the castings exit conveyor 56, either individually in conveying lanes such as previously described or on a pallet such as 25, to a quenching bath 78 for a conventional casting chilling process. During the chilling of the metal castings 12, they may be transported by any conventional means including a vibratory conveyor of the type described to a pick-off station 80 where they can be retrieved.

When utilizing a pallet 25, a robot may place a selected number of sand molds containing metal castings 12 in predetermined locations. These locations are known and correspond to where the casting supporting bins 25*a* are positioned in the pallet 25. Thereafter, when processing is complete, another robot may remove the metal castings 12 from the pallet 25 since their locations will not have changed.

With the present invention, it has become possible to exclusively utilize vibratory conveying means rather than roller conveyors. This holds true not only for conveying the metal castings during removal and reclamation of sand but also for the recirculation of sand. Moreover, this is done by producing a constantly circulating supply of hot sand to immediately cover the sand molds containing the hot metal castings 12.

By recirculating the hot sand through an insulated conveying system, it is possible to reduce the cost of energy that is required to pyrolyze the binder in the sand molds and sand cores since it is not necessary to entirely reheat recirculated sand. It is also noteworthy that the vibratory conveying of the metal castings through fluidized sand helps to produce a uniform temperature in the sand within the fluidized bed 20. In particular, this result is enhanced by the vertical force component of the vibratory conveying motion imparted to the castings in the system shown, even in the first, lower motor or drive speed, as the castings are conveyed through the fluidized bed 20. More specifically, the vertical force component caused by the vibratory movement serves to multiply the effect of fluidization by creating an even more thorough mixing of the hot air with the hot sand, the hot sand with itself, and contact of the hot sand with the sand mold, sand core and casting during the sand reclamation process. As a result, it is possible to achieve a much higher efficiency of heat transfer in contrast to blowing or other wise forcing hot air over the castings.

Figure 10:
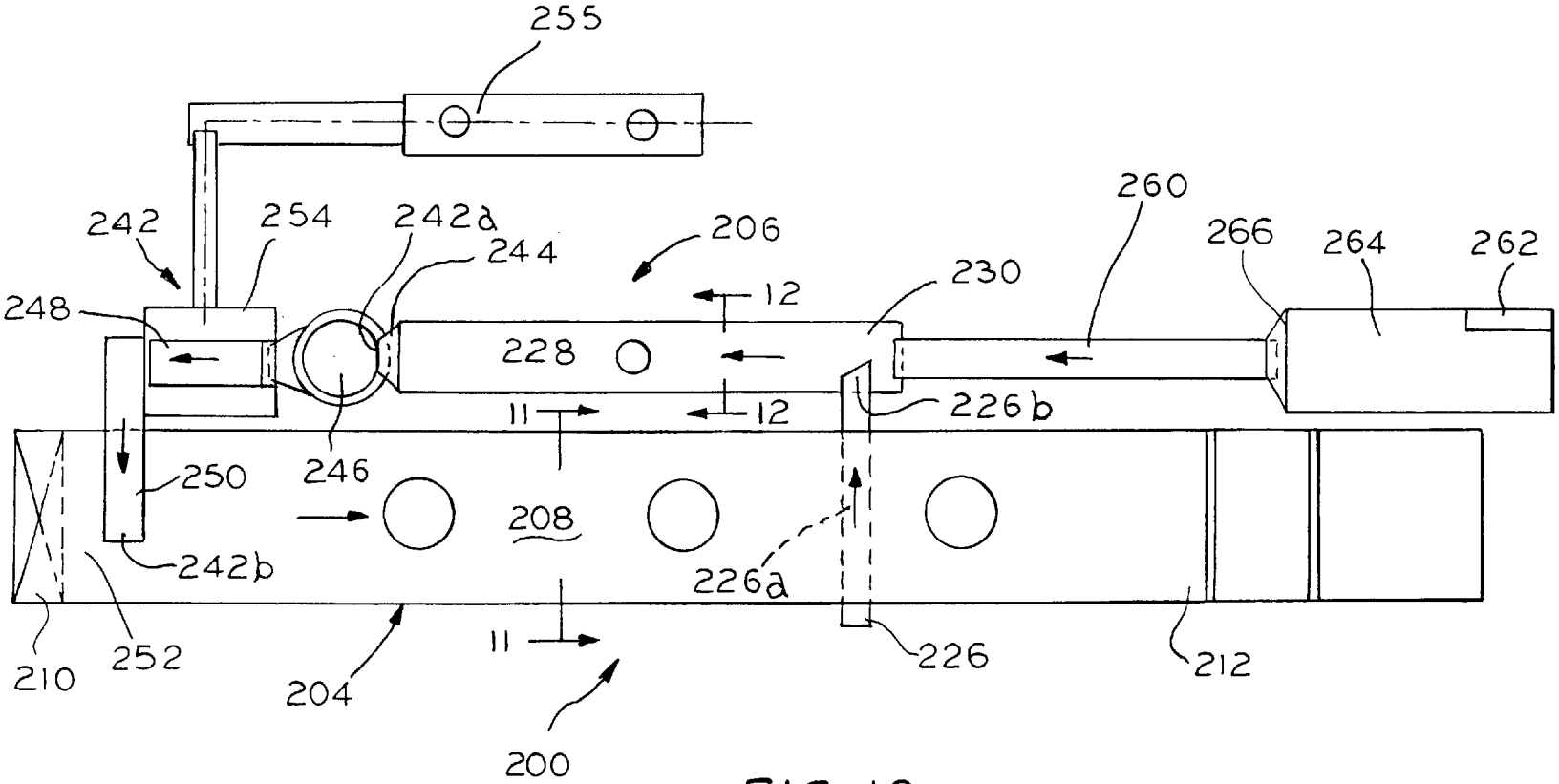
FIG. 10 is a plan view similar to FIG. 1 illustrating still another alternative embodiment.
Figure 12:
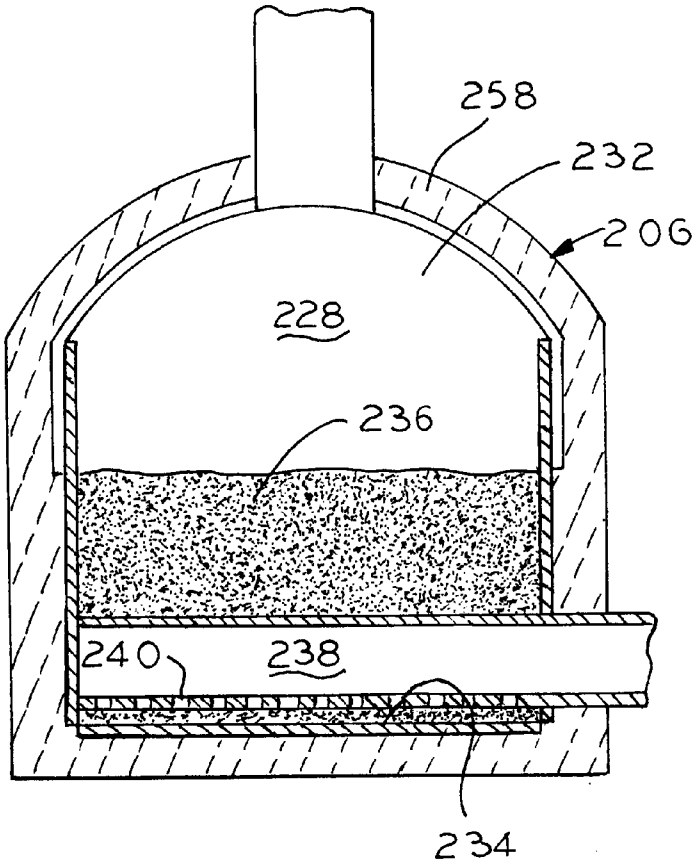
FIG. 12 is an elevational cross-sectional view taken generally along the lines 12—12 of FIG. 10.
Figure 11:
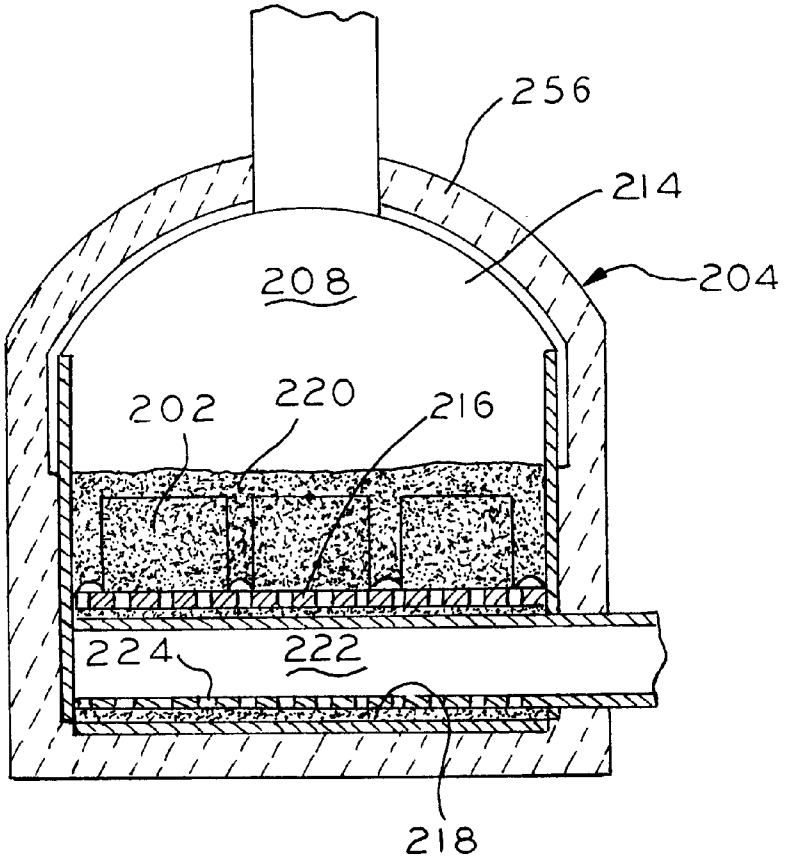
FIG. 11 is an elevational cross-sectional view taken generally along the lines 11—11 of FIG. 10.

Referring to FIGS. 10–12, still another alternative embodiment of the present invention has been illustrated in the form of a two-stage system generally designated 200 for processing metal castings 202 and core sand formed of sand and binder. The two-stage system 200 will be seen to include a first stage which is generally designated 204 for removing the core sand from the metal castings 202 and heat treating the metal castings. Referring specifically to FIG. 10, the two-stage system 200 will also be seen to include a separate, second stage which is generally designated 206 for thereafter reclaiming at least the core sand which has been removed from the metal castings 202 for reuse.

Referring to FIG. 10 which schematically illustrates the first stage 204 of the two-stage system 200, means are provided in the form of a castings conveyor 208 having a casting entrance as at 210 for receiving the castings 202 and a casting exit as at 212 for removing the castings. The castings conveyor 208 of the first stage 204 comprises a first heated chamber 214 (see FIG. 11) having a support surface 216 for the castings 202 and also having a support surface 218 for the sand 220 and, in addition, a first plenum 222 is provided for directing hot air first downwardly through holes 224 and then upwardly through the sand 220 on the support surface 218 into the first heated chamber 214. As will be appreciated by referring to FIG. 11, the first plenum 222 comprises means for fluidizing and heating the sand 220 in the conveying means 208 of the first stage 204 and, preferably, there will be a plurality of such plenums 222 disposed transversely along the length thereof.

By controlling the temperature of the hot air that is delivered to the first plenum 222, it is possible to heat the sand 220 in the conveying means 208 of the first stage 204 to a substantially uniform heat treating temperature. It is thereby possible to cause the castings 202 to be heat treated in the first stage 204 while at the same time causing the binder in the core sand within the castings to break down such that the core sand is removed from the castings in at least clumps of core sand and binder. Once the binder in the core sand has been broken down, a transfer conveyor 226 (FIG. 10) transfers all of the sand 220 from the conveying means 208 of the first stage 204 including the core sand removed from the castings 202.

More specifically, the transfer conveyor 226 transfers all of the sand, including any clumps of core sand and binder, to the second stage 206 to fully reclaim the core sand for reuse, by completely pyrolyzing the binder while the core sand is within the second stage 206.

Referring to the second stage 206 of the two-stage system 200, means are provided in the form of a sand conveyor 228 in the second stage 206 having a sand entrance as at 230 for receiving all of the sand 220 from the transfer conveyor 226 of the first stage 204. The sand conveyor 228 of the second stage 206 comprises a second heated chamber 232 (see FIG. 12) having a support surface 234 for the sand, as at 236, which was received from the first stage 204 and, in addition, a second plenum 238 is provided for directing hot air first downwardly through holes 240 and then upwardly through the sand 236 on the support surface 234 into the second heated chamber 232. As will be appreciated by referring to FIG. 12, the second plenum 238 comprises means for fluidizing and heating the sand 236 in the conveying means 228 of the second stage 206 and, preferably, there will again be a plurality of such plenums 238 disposed along the length thereof.

By controlling the temperature of the hot air that is delivered to the second plenum 238, it is possible to heat the sand 236 in the conveying means 228 of the second stage 206 to a sand reclamation temperature to fully reclaim the sand as it moves along the conveying means 228. Preferably, the core sand removed from the castings 202 in the first stage 204, and including any clumps of core sand and binder, is subjected to heat fully sufficient to completely pyrolyze the binder in the second stage 206 to cause the core sand to be reclaimed for reuse. Once the core sand has been reclaimed, a sand recirculating conveyor system generally designated 242 recirculates at least a portion of the hot sand 236 from the conveying means 228 of the second stage 206 to the conveying means 208 of the first stage 204 which results in substantial energy conservation. Moreover, because the castings 202 are never present in the separate, second stage 206, it is possible to choose a sand reclamation temperature greatly in excess of the substantially uniform heat treating temperature required in the first stage 204.

Referring once again to FIG. 11, the support surface 216 defines at least a portion of a continuous casting conveying path extending from the casting entrance 210, to and through the conveying means 208, and then to the casting exit 212.

Similarly, the support surface 234 advantageously defines at least a portion of a continuous sand conveying path extending from the sand entrance 230, to and through the conveying means 228, and then to a sand exit at 244.

As shown in FIG. 10, the sand transfer conveyor 226 has a major upstream section 226*a* positioned below and transversely of the conveying means 208 of the first stage 204 to receive sand through a chute or the like (not shown), and it also has a downstream end as at 226*b* positioned in communication with the conveying means 228 to discharge sand directly into the second stage 206. As also shown in FIG. 10, the sand recirculating conveyor system 242 has an upstream end 242*a* to receive sand from the conveying means 228 of the second stage 206 at the sand exit 244 and has a downstream end 242*b* positioned above the conveying means 208 to discharge sand directly into the first stage 204.

As for other features of the two-stage system 200 illustrated in FIGS. 10–12, it may include any suitable means for diverting excess sand downstream of where the core sand has been reclaimed for reuse in the conveying means 228 of the second stage 206. Thus, for example, the sand recirculating conveyor system 242 may include a spiral elevator 246 that receives the reclaimed sand when it is discharged at the sand exit 244, and the spiral elevator 246 can cause the reclaimed sand to follow a helical path to an intermediate conveyor 248 which, in turn, can convey the reclaimed sand to a delivery conveyor 250. As will be appreciated from the description of the other embodiments, the reclaimed sand can then be used to cover the castings 202 that are continuously introduced as at 252 into the first stage 202 at the casting entrance 210 to undergo heat treatment and decoring.

As for excess sand that is generated through the reclaiming process, a collector 254 may be placed below the intermediate conveyor 248, and the excess sand can be permitted to spill off from the intermediate conveyor 248 onto the collector 254. And as shown in FIG. 10, it will be further appreciated that the excess sand which spills off can then be conveyed away from the collector 254 to a sand cooler 255 following which it can be transported to another location for reuse since it will have been fully reclaimed in the second stage 206.

While also not specifically shown in FIGS. 10–12, it will be appreciated that the two-stage system 200 advantageously includes means for vibrating the conveying means 208 and 228 of the first and second stages 204 and 206, respectively. The vibrating means which may advantageously take the form of that described in connection with the other embodiments above will be suitable to convey the castings 202 and sand 220 in the first stage 204 generally from the casting entrance 210 toward the casting exit 212 and to convey the sand 236 generally from the sand entrance 230 to the sand exit 244. By also providing insulated walls 256 and 258, respectively, for the first and second heated chambers 214 and 232, the respective conveying means 208 and 228 of the first and second stages 204 and 206 may each thereby comprise an insulated vibratory fluidized conveyor.

As for the fluidization, and as previously discussed, this is provided by directing hot air through the first and second plenums 222 and 238 for passage through the holes 224 and 240, respectively, which allow the hot air to pass first downwardly and then upwardly through the sand 220 and 236 into the first and second heated chambers 214 and 232.

In yet another respect, the embodiment illustrated in FIGS. 10–12 may include a core sand transfer conveyor 260 for conveying core sand formed of sand and binder from a separate location such as a core room directly to the second stage 206. The cores delivered from the core room may advantageously be deposited in a core entry 262 of a vibrating drum 264 that causes the cores to be broken into clumps of core sand and binder following which the clumps are permitted to exit as at 266 onto the core sand transfer conveyor 260 to be merged with the sand from the bed of the first stage 204, including the core sand removed from the castings 202 as well as any clumps of core sand and binder therein. With this arrangement for the invention, the two-stage system 200 of the present invention makes it possible to fully reclaim all core sand in a foundry for reuse by completely pyrolyzing the binder while the core sand is within the second stage 206.

Since the heat treatment and decoring is occurring in the first stage 204, it is advantageous for the first and second stages 204 and 206 to be operated at significantly different temperatures. Thus, the substantially uniform heat treating temperature required in the first stage 204 is a first temperature selected for effectively and efficiently heat treating the metal castings 202 while causing the cores to be removed therefrom whereas a much higher sand reclamation temperature advantageously comprises a second temperature selected so that complete sand reclamation can be achieved in the second stage 206 inasmuch as the metal castings 202 are not present in this portion of the two-stage system 200. As a result, the core sand can be reclaimed in a much shorter time interval and the additional heat added to the sand in the second stage 206 is significantly retained due to the insulated nature of the two-stage system 200.

As for other details of the embodiment illustrated in FIGS. 10–12, it will be appreciated by those skilled in the art that they may utilize the corresponding aspects of the earlier embodiments described and illustrated in FIGS. 1–9. It will also be appreciated that the hot air to be delivered to the first and second plenums 222 and 238 may be provided by a common furnace or two separate furnaces, the latter likely being preferable. Further, it may be desirable to utilize a furnace that delivers an oxygen-poor gas to the first plenum 222 in order to inhibit combustion of binder to maintain a substantially uniform heat treating temperature.

Conversely, with respect to the second heated chamber 232, a different furnace may be utilized to provide an oxygen-rich environment to the second plenum 238 at an elevated temperature in order to ensure full combustion of binder to facilitate the reclamation of sand for reuse.

As will also be appreciated, many of the details of construction are can take a variety of different forms that will be readily apparent to anyone skilled in the art and, thus, are not important for understanding the inventive concept. For instance, in addition to the conveying means 208 and 228, some or all of the other conveyors including the sand transfer conveyor 226, the spiral elevator 246, the intermediate conveyor 248, and the delivery conveyor 250 may be vibratory insulated conveyors for conveying sand while at the same time promoting energy efficiency by retaining the heat that has been added to the sand by hot air delivered through the plenums 22 and 238. Furthermore, it will be understood that conventional heat sealing techniques may be utilized in ways that are known in the art to retain heat as the sand moves from one portion of the two-stage system to the other.

As for operating parameters such as capacities, temperatures, processing times, conveyor lengths, and the like, these are dependent upon the particular application and are clearly within the ability of those skilled in the art.

By reason of the present invention, the uniformity of heat in the conveying sand and, thus, heat transfer efficiency has been maximized, in an apparatus and systems having truly unique attributes in relation to any apparatus and systems heretofore known.

While in the foregoing there have been set forth preferred embodiments of the invention, it will be appreciated that the details herein given may be varied by those skilled in the art without departing from the true scope and spirit of the appended claims.

We claim:

1. A two-stage system for processing metal castings and core sand formed of sand and binder, including a first stage for removing said core sand from said metal castings and heat treating said metal castings, and including a separate, second stage for thereafter reclaiming at least said core sand removed from said metal castings for reuse, said system comprising, in said first stage:

means for conveying said castings and sand in said first stage and including a casting entrance for receiving said castings and a casting exit for removing said castings;

means for fluidizing and heating said sand in said conveying means of said first stage to a substantially uniform heat treating temperature to thereby cause said castings to be heat treated while at the same time causing said binder in said core sand within said castings to break down such that said core sand is removed from said castings in at least clumps of said core sand and binder; and means for transferring all of said sand from said conveying means of said first stage to said second stage including said core sand removed from said castings, and including any clumps of said core sand and binder, to fully reclaim said core sand for reuse by completely pyrolyzing said binder while said core sand is within said second stage;

said system comprising, in said second stage:

means for conveying said sand in said second stage and including a sand entrance for receiving all of said sand from said sand transferring means of said first stage;

means for fluidizing and heating said sand in said conveying means of said second stage to a sand reclamation temperature to thereby cause said core sand removed from said castings in said first stage, and including any clumps of said core sand and binder, to be subjected to heat sufficient to completely pyrolyze said binder in said second stage to cause said core sand to be reclaimed for reuse; and means for recirculating at least a portion of said sand from said conveying means of said second stage to said conveying means of said first stage after said core sand has been reclaimed for reuse.

2. The two-stage system of claim 1 wherein said conveying means of said first stage comprises a first heated chamber having a support surface for said castings and a support surface for said sand and a first plenum for directing hot air upwardly through said sand into said first heated chamber.

3. The two-stage system of claim 1 wherein said conveying means of said second stage comprises a second heated chamber having a support surface for said sand from said first stage and a second plenum for directing hot air upwardly through said sand into said second heated chamber.

4. The two-stage system of claim 2 wherein said casting support surface defines at least a portion of a continuous casting conveying path, said continuous casting conveying path extending from said a casting entrance, to and through said conveying means of said first stage, and then to said casting exit.

5. The two-stage system of claim 3 wherein said sand support surface defines at least a portion of a continuous sand conveying path, said continuous sand conveying path extending from said sand transferring means, to and through said conveying means of said second stage, and then to said sand recirculating means.

6. The two-stage system of claim 1 wherein said sand transferring means comprises a sand transfer conveyor having a major upstream section positioned to receive sand from said conveying means of said first stage and having a downstream end positioned to transfer sand to said conveying means of said second stage.

7. The two-stage system of claim 1 wherein said sand recirculating means comprises a sand recirculating conveyor having an upstream end positioned to receive sand from said conveying means of said second stage and having a downstream end positioned to transfer sand to said conveying means of said first stage.

8. The two-stage system of claim 1 including means for diverting excess sand downstream of where said core sand has been reclaimed for reuse.

9. The two-stage system of claim 1 wherein said conveying means of said first and second stages each comprise an insulated vibratory fluidized conveyor.

10. The two-stage system of claim 1 wherein said substantially uniform heat treating temperature is a first selected temperature and said sand reclamation temperature is a second, higher selected temperature.

11. The two-stage system of claim 1 including means for conveying core sand formed of sand and binder from a separate location directly to said second stage, to be merged with said sand from said conveying means of said first stage, including said core sand removed from said castings, and including any clumps of said core sand and binder, to fully reclaim said core sand for reuse by completely pyrolyzing said binder while said core sand is within said second stage.

12. A two-stage system for processing metal castings and core sand formed of sand and binder, including a first stage for removing said core sand from said metal castings and heat treating said metal castings, and including a separate, second stage for thereafter reclaiming at least said core sand removed from said metal castings for reuse, said system comprising, in said first stage:

means for conveying said castings and sand in said first stage and including a casting entrance for receiving said castings and a casting exit for removing said castings;

means for fluidizing and heating said sand in said conveying means of said first stage to a substantially uniform heat treating temperature to thereby cause said castings to be heat treated while at the same time causing said binder in said core sand within said castings to break down such that said core sand is removed from said castings in at least clumps of said core sand and binder;

said conveying means of said first stage comprising a first heated chamber having a support surface for said castings and a support surface for said sand and a first plenum for directing hot air upwardly through said sand into said first heated chamber and including means for vibrating said conveying means of said first stage to convey said castings and said sand generally from said casting entrance toward said casting exit; and means for transferring all of said sand from said conveying means of said first stage including said core sand removed from said castings, and including any clumps of said core sand and binder, to said second stage to fully reclaim said core sand for reuse by completely pyrolyzing said binder while said core sand is within said second stage;

said sand transferring means being in communication with said conveying means of said first stage intermediate said casting entrance and said casting exit;

said system comprising, in said second stage:

means for conveying said sand in said second stage and including a sand entrance for receiving all of said sand from said sand transferring means of said first stage;

means for fluidizing and heating said sand in said conveying means of said second stage to a sand reclamation temperature to thereby cause said core sand removed from said castings in said first stage, and including any clumps of said core sand and binder, to be subjected to heat sufficient to completely pyrolyze said binder in said second stage to cause said core sand to be reclaimed for reuse;

said conveying means of said second stage comprising a second heated chamber having a support surface for said sand from said first stage and a second plenum for directing hot air upwardly through said sand into said second heated chamber and including means for vibrating said bed of said second stage to convey said sand generally from said sand entrance to a sand exit; and means for recirculating at least a portion of said sand from said conveying means of said second stage to said conveying means of said first stage after said core sand has been reclaimed for reuse;

said sand recirculating means being in communication with said conveying means of said second stage generally at said sand exit of said conveying means of said second stage.

13. The two-stage system of claim 12 wherein said casting support surface of said first stage defines at least a portion of a continuous casting conveying path, said continuous casting conveying path extending from said casting entrance, to and through said conveying means of said first stage, and then to said casting exit.

14. The two-stage system of claim 12 wherein said sand support surface of said second stage defines at least a portion of a continuous sand conveying path, said continuous sand conveying path extending from said sand transferring means, to and through said bed of said second stage, and then to said sand recirculating means.

15. The two-stage system of claim 12 wherein said sand transferring means comprises a sand transfer conveyor in communication with said conveying means of said first stage intermediate said casting entrance and said casting exit and having a major upstream section positioned to receive sand from said conveying means of said first stage and having a downstream end positioned to transfer sand to said conveying means of said second stage.

16. The two-stage system of claim 12 wherein said sand recirculating means comprises a sand recirculating conveying system in communication with said conveying means of said second stage generally at said sand exit of said bed of said second stage and having an upstream end positioned to receive sand from said conveying means of said second stage and having a downstream end positioned to transfer sand to said conveying means of said first stage.

17. The two-stage system of claim 12 including means for diverting excess sand downstream of where said core sand has been reclaimed for reuse.

18. The two-stage system of claim 12 wherein said conveying means of said first and second stages each comprise an insulated vibratory fluidized conveyor.

19. The two-stage system of claim 12 wherein said means for vibrating said conveying means of said first stage produces vibratory forces to convey said castings and said sand generally from said casting entrance toward said casting exit.

20. The two-stage system of claim 12 wherein said means for vibrating said bed of said second stage produces vibratory forces to convey said sand generally from said sand entrance to said sand exit for recirculating at least a portion of said sand.

21. The two-stage system of claim 12 wherein said substantially uniform heat treating temperature is a first selected temperature and said sand reclamation temperature is a second, higher selected temperature.

22. The two-stage system of claim 12 including means for conveying core sand formed of sand and binder from a separate location directly to said sand entrance of said second stage, to be merged with said sand from said conveying means of said first stage, including said core sand removed from said castings, and including any clumps of said core sand and binder, to fully reclaim said core sand for reuse by completely pyrolyzing said binder while said core sand is within said second stage.

23. A two-stage vibratory system for processing metal castings and core sand formed of sand and binder, including a first vibratory stage for removing said core sand from said metal castings and heat treating said metal castings, and including a separate, second vibratory stage for thereafter reclaiming at least said core sand removed from said metal castings for reuse, said system comprising, in said first vibratory stage:

means for conveying said castings and sand in said first vibratory stage and including a casting entrance for receiving said castings and a casting exit for removing said castings;

means for fluidizing and heating said sand in said conveying means of said first vibratory stage to a substantially uniform heat treating temperature to thereby cause said castings to be heat treated while at the same time causing said binder in said core sand within said castings to break down such that said core sand is removed from said castings in at least clumps of said core sand and binder;

said conveying means of said first vibratory stage comprising a first heated chamber having a grid-like support surface for said castings and a support surface for said sand and a first plenum below said grid-like support surface for directing hot air upwardly through said sand into said first heated chamber and including means for vibrating said conveying means of said first vibratory stage to convey said castings and said sand generally from said casting entrance toward said casting exit;

said vibrating means of said first vibratory stage producing vibratory forces to convey said castings and said sand generally from said casting entrance toward said casting exit; and means for transferring all of said sand from said conveying means of said first vibratory stage including said core sand removed from said castings, and including any clumps of said core sand and binder, to said second vibratory stage to fully reclaim said core sand for reuse by completely pyrolyzing said binder while said core sand is within said second vibratory stage;

said sand transferring means being in communication with said conveying means of said first vibratory stage intermediate said casting entrance and said casting exit;

said system comprising, in said second vibratory stage:

means for conveying said sand in said second vibratory stage and including a sand entrance for receiving all of said sand from said sand transferring means of said first vibratory stage;

means for fluidizing and heating said sand in said conveying means of said second vibratory stage to a sand reclamation temperature to thereby cause said core sand removed from said castings in said first vibratory stage, and including any clumps of said core sand and binder, to be subjected to heat sufficient to completely pyrolyze said binder in said second vibratory stage to cause said core sand to be reclaimed for reuse;

said conveying means of said second vibratory stage comprising a second heated chamber having a support surface for said sand from said first vibratory stage and a second plenum for directing hot air upwardly through said sand into said second heated chamber and including means for vibrating said conveying means of said second vibratory stage to convey said sand generally from said sand entrance to a sand exit;

said vibrating means of said second vibratory stage producing vibratory forces to convey said sand generally from said sand entrance to said sand exit for recirculating at least a portion of said sand; and means for recirculating at least a portion of said sand from said conveying means of said second vibratory stage to said conveying means of said first vibratory stage after said core sand has been reclaimed for reuse;

said sand recirculating means being in communication with said conveying means of said second vibratory stage generally at said sand exit of said conveying means of said second vibratory stage.

24. The two-stage vibratory system of claim 23 wherein said substantially uniform heat treating temperature is a first selected temperature and said sand reclamation temperature is a second, higher selected temperature.

25. The two-stage vibratory system of claim 23 including means for conveying core sand formed of sand and binder from a separate location directly to said sand entrance of said second stage, to be merged with said sand from said bed of said first stage, including said core sand removed from said castings, and including any clumps of said core sand and binder, to fully reclaim said core sand for reuse by completely pyrolyzing said binder while said core sand is within said second stage.

* * * * *